US007042369B2

(12) United States Patent
Hill et al.

(10) Patent No.: US 7,042,369 B2
(45) Date of Patent: May 9, 2006

(54) ROAD TRAFFIC MONITORING SYSTEM

(75) Inventors: David J Hill, Newburgh (GB); Philip J Nash, Newburgh (GB)

(73) Assignee: QinetiQ Limited, Hants (GB)

( * ) Notice: Subject to any disclaimer, the term of this patent is extended or adjusted under 35 U.S.C. 154(b) by 0 days.

(21) Appl. No.: 10/467,075

(22) PCT Filed: Feb. 11, 2002

(86) PCT No.: PCT/GB02/00573

§ 371 (c)(1),
(2), (4) Date: Aug. 5, 2003

(87) PCT Pub. No.: WO02/065425

PCT Pub. Date: Aug. 22, 2002

(65) Prior Publication Data

US 2004/0080432 A1 Apr. 29, 2004

(30) Foreign Application Priority Data

Feb. 15, 2001 (GB) ..... 0103665

(51) Int. Cl.
*G08G 1/04* (2006.01)

(52) U.S. Cl. ..... 340/942; 340/933; 340/934; 340/935; 340/936; 385/12; 385/14; 385/31; 385/32; 385/34; 385/54

(58) Field of Classification Search ..... 340/933–936, 340/942; 385/12–14, 31–32, 34, 54
See application file for complete search history.

(56) References Cited

U.S. PATENT DOCUMENTS 5,026,141 A * 6/1991 Griffiths ..... 385/13
5,056,884 A * 10/1991 Quinlan, Jr. ..... 385/13
5,194,847 A * 3/1993 Taylor et al. ..... 340/557
5,260,520 A 11/1993 Muhs et al.
5,446,291 A * 8/1995 Becker et al. ..... 250/559.24

FOREIGN PATENT DOCUMENTS

FR 2 673 749 A 9/1992
FR 2 703 451 A 10/1994

OTHER PUBLICATIONS

Patent Abstracts of Japan; vol. 1998, No. 11, Sep. 30, 1998; & JP 10 148586 A, Jun. 2, 1998.

* cited by examiner

*Primary Examiner*—Julie Bichngoc Lieu
(74) *Attorney, Agent, or Firm*—Nixon & Vanderhye P.C.

(57) ABSTRACT

A traffic monitoring system comprises at least one sensor station (2) and an interferometric interrogation system (9); wherein the at least one sensor station (2) comprises at least one optical fiber sensor (5) deployed in a highway (1); and wherein the interferometric interrogation system (9) is adapted to respond to an optical phase shift produced in the at least one optical fiber sensor (5) due to a force applied by a vehicle passing the at least one sensor station (2).

34 Claims, 7 Drawing Sheets

ROAD TRAFFIC MONITORING SYSTEM

This application is the US national phase of international application PCT/GB02/00573 filed Feb. 11, 2002, which designated the US.

This invention relates to a road traffic monitoring system incorporating a multiplexed array of fibre optic sensors, fibre optic sensors for use in such a system, and a method of traffic monitoring using such a system.

There are several reasons why information regarding road traffic on a particular section of road may be collected. One of these may be for the effective management of road traffic where information regarding the speed and volume of traffic is useful. This enables alternative routes to be planned in response to accidents or road closures and to attempt to relieve congestion, perhaps by altering speed limits.

Many new roads are built with a sacrificial top layer which is designed to wear out and be replaced. The significant costs associated with road repairs and road building, in addition to the disruption caused by such works, requires that repairs are carried out only when needed. The sacrificial layer should neither be replaced too soon, leading to unnecessary costs, nor too late, risking more serious damage to the underlying structure of the road. An accurate determination of the volume of traffic on a particular road section is therefore essential.

A further reason why traffic information is required is for the enforcement of regulations and laws. There are regulations relating to maximum allowable weights for heavy goods vehicles (HGVs) which are borne out of concerns for safety and also to lessen the damage that overladen vehicles may do to the road structure. A measure of dynamic vehicle weight helps to ensure that such regulations are adhered to.

Simple information regarding vehicle speed may be used to monitor and enforce speed limits.

There may also be a requirement to collect information regarding the types of vehicle using a particular section of road. This may be to prevent unsuitable vehicles such as HGVs from using rural roads or to plan future road building schemes. Classification of vehicle type may be achieved from a determination of dynamic vehicle weight and axle count.

It is clear that information regarding the speed, weight, volume and type of traffic can all be used to help with an effective road traffic management programme. There are several methods in use to obtain this information, however these have associated problems.

Many sections of road are overseen by video cameras. The images from these cameras are fed to central points to be analysed to provide information regarding vehicle speed and type and traffic volume. However, due to the complexity of the images, it is not always possible to reliably automate the analysis of the data received, meaning that they must be studied visually. There is a limit to how many images can be analysed in this way. Furthermore, the quality of the images collected may be influenced by weather conditions. Fog or rain can obscure the field of view of the cameras, as can high vehicles; and high winds can cause the cameras to vibrate. In many countries, camera systems are operated by law enforcement agencies, so there is often an added complication in making the information collected available to the agencies involved with traffic management. It is also not possible to determine the weight of a vehicle from a video image. The commissioning costs of video camera systems for traffic monitoring can also be high.

The vast majority of new roads and large numbers of existing roads are provided with inductive sensors. These are wire loops which are placed below the road surface. As a vehicle passes over the sensor, the metal parts of the vehicle, i.e. the engine and the chassis, change the frequency of a tuned circuit of which the loop is an integral part. This signal change can be detected and interpreted to give a measure of the length of a passing vehicle. By placing two loops in close proximity to one another, it is also possible to determine the vehicle's speed. The quality of the data collected by inductive loop sensors is not always high and is further compromised by the facts that the trend in many modern vehicles is to have fewer metal parts. This leads to a smaller signal change which is more difficult to interpret. Although cheap to produce, inductive sensors are large and as such their placement, particularly in existing roads, causes significant disruption. This has associated costs. A major drawback with the use of inductive loops for traffic management is that they are not amenable to multiplexing. Each sensor site requires its own data collection system, power supply and data communication unit. This increases the cost of the complete sensor significantly, which results in the majority of installed inductive loops not being connected, and therefore incapable of collecting data. Furthermore, although inductive loops can be used to count vehicles and, if deployed in pairs, to determine vehicle speed, they cannot be used to measure dynamic vehicle weight. Vehicle classification is thus not possible.

Two methods for determining the weight of vehicles, in particular HGVs are in common use. Vehicle weight can be measured using a weigh-bridge. This is very accurate but requires the vehicle to leave the highway to a specific location where the measurement can take place. An alternative method is to attempt to measure the weight of the vehicle as it is in transit. Commonly, piezo-electric cables are placed under the surface of the road which produce a signal proportional to the weight of the vehicle as it passes over. This method is more convenient but less accurate than a weigh-bridge. As with inductive loop sensors, piezo-electric sensors are not amenable to multiplexing so each requires a similar data-collection systems power supply and data communication unit. The sensors are also more expensive and less robust than inductive loop sensors.

In order to obtain the maximum amount of information regarding traffic on a particular section of road, piezo-electric sensors are often deployed in tandem with inductive loops.

Optical fibre interferometric sensors can be used to detect pressure. When a length of optical fibre is subjected to an external pressure the fibre is deformed. This deformation alters the optical path length of the fibre which can be detected as a change in phase of light passing along the fibre. As it is possible to analyse for very small changes in phase, optical fibre sensors are extremely sensitive to applied pressure. Such a sensor is described as an interferometric sensor. This high sensitivity allows optical fibre sensors to be used for example, in acoustic hydrophones where sound waves with intensities equivalent to a pressure of $10^{-4}$ Pa are routinely detectable. Such high sensitivity can however also cause problems. Optical fibre interferometric sensors are not ideally suited for use in applications where a low sensitivity is required, for example for detecting gross pressure differences in an environment with high background noise. However, optical fibre sensors have the advantage that they can be multiplexed without recourse to local electronics. Interferometric sensors can also be formed into distributed sensors with a length sufficient to span the width of a highway. This is in contrast to for example, Bragg grating sensors which act as point sensors.

In accordance with a first aspect of the present invention a traffic monitoring system comprises at least one sensor station and an interferometric interrogation system; wherein the at least one sensor station comprises at least one optical fibre sensor deployed in a highway; and wherein the interferometric interrogation system is adapted to respond to an optical phase shift produced in the at least one optical fibre sensor due to a force applied by a vehicle passing the at least one sensor station.

This provides a low cost, reliable traffic monitoring system which can be highly multiplexed. Remote interrogation is possible so neither local electronics nor local electrical power are required.

Preferably, the interferometric interrogation system comprises a reflectometric interferometric interrogation system, more preferably the interferometric interrogation system comprises a pulsed reflectometric interferometric interrogation system.

In a system where time division multiplexing is used to distinguish individual sensors, reflectometric and particularly, pulsed reflectometric interferometry allow for a very efficient multiplexing architecture that can be used with distributed sensors.

Alternatively, the interferometric interrogation system comprises a Rayleigh backscatter interferometric interrogation system, with a pulsed Rayleigh backscatter interferometric interrogation system being particularly preferred.

A non-Rayleigh backscattering reflectometric system relies upon discrete reflectors between sensors. These are comparatively expensive components, which may add to the cost of the overall system. In contrast, Rayleigh backscattering relies on reflection of light from inhomogeneities in the optical fibre. This removes the need for discrete reflectors, reducing the overall cost of the system. However, the data collected from such a system requires more complex analysis than a reflectometric interrogation system.

Preferably, the system comprises a plurality of sensor stations, wherein adjacent stations are connected together by a length of optical fibre.

The length of optical fibre connecting adjacent sensor stations defines the optical path length between adjacent sensor stations. Commonly, the connecting optical fibre is extended, and as such the optical path length between adjacent sensor stations is substantially equal to their physical separation. However, the connecting optical fibre need not be fully extended, in which case the physical separation of adjacent sensor stations may be any distance up to that of the length of the optical fibre used to connect adjacent sensor stations.

Conveniently, the length of optical fibre connecting adjacent sensor stations is between 100 m and 5000 m.

Preferably, each sensor station comprises a plurality of fibre optic sensors, more preferably, each sensor station comprises at least one fibre optic sensor per lane of the highway.

Most preferably, each sensor station comprises at least two optical fibre sensors, separated from each other by a known distance, per lane of the highway.

Suitably, the known distance is between 0.5 m and 5 m. The known distance refers to the physical separation of the fibre optic sensors and not to the optical path length of the optical fibre between each sensor.

This provides a traffic monitoring system which can be employed to monitor traffic on any type of highway, from a single lane road to a multi-lane motorway. The sensor stations may be sited at intervals along the entire length of the highway or only on sections where traffic monitoring is crucial, for example at known congestion sites or accident blackspots.

Ensuring that each lane of the highway has at least one fibre optic sensor means that some traffic information can be collected irrespective of the part of the highway on which traffic is flowing. The simplest system for a single lane highway would have two sensors, one for each direction of traffic. Although this would give information regarding vehicle weight, traffic volume and axle count, it could not be used to give a measure of vehicle speed. Vehicle speed may however be determined by placing two sensors, separated by a known, short distance, per lane of the highway. It may be desirable to place more than two sensors per lane of the highway, for example three sensors placed in close proximity to each other may be used to give a measure of vehicle acceleration. Such a measurement may be of use at road junctions, roundabouts or traffic lights.

Preferably, the optical fibre sensor comprises a sensing fibre coupled to a dummy fibre; wherein the optical path length of the sensing fibre is such that the sensitivity of the sensor is low; and wherein the optical path length of the dummy fibre is greater than that of the sensing fibre such that the combined optical pace length of the sensing fibre and the dummy fibre is sufficient to allow the sensor to be interrogated by a pulsed interferometric interrogation system.

Preferably, the optical path length of the dummy fibre is at least 2 times greater than that of the sensing fibre.

The sensitivity of an optical fibre sensor is substantially proportional to the length of the optical fibre it contains. The length of the sensing section is preferably short in order to reduce the sensitivity of the sensor to a level where a reliable measurement of the large forces associated with vehicle traffic is possible. However, a short section of optical fibre cannot easily be interrogated using a pulsed interferometric system. This is because the minimum pulse length is limited by optical switch performance. By using a dummy fibre, the total optical path length of the sensor is increased so that pulsed interferometric interrogation is made simpler.

Preferably, the sensing fibre is substantially straight.

Preferably, the sensing fibre and the dummy fibre comprise sections of a single optical fibre. This simplifies the construction of the sensor. Alternatively, the sensing fibre and the dummy fibre may be spliced together or joined by any other suitable means.

Preferably, the sensor further comprises a casing substantially surrounding at least one of the sensing fibre and the dummy fibre.

Alternatively, the optical fibre sensor comprises a former and an optical fibre wound on the former; wherein the former is substantially planar; and wherein the sensor is sufficiently flexible such that it is able to substantially adopt the shape of the camber of a highway.

This type of sensor is easy to store and deploy. It may be wound onto a spool for storage and transportation, and unwound and cut to the required length as required. Allowing the sensor to conform to the camber of the highway into which it is deployed makes it simple to ensure that the sensor is at a uniform depth below the highway surface. This helps to improve the uniformity of response along the length of the sensor.

Preferably, the former comprises an elongate strip provided with two spindles; wherein the spindles are fixedly attached to the same face of the strip and disposed at a distance from each other; wherein each spindle protrudes substantially perpendicularly from the surface of the strip; and wherein the optical fibre is wound longitudinally between the spindles.

For ease of handling and deployment, it is desirable that the spindles are short in comparison to the length of the strip. A typical sensor may have a 3 m long strip with 5 mm long spindles. This is sufficient to wind the required length of optical fibre, yet results in a sensor which is thin enough to remain flexible Alternatively, the former comprises an elongate strip and the optical fibre is wound longitudinally around the long axis of the strip.

In yet another alternative design, the former comprises an elongate strip and the optical fibre is wound helically around the short axis of the strip.

Preferably, the elongate strip comprises a metal strip. Examples of suitable metals include steels, tin alloys, aluminium alloys.

Alternatively, the elongate strip comprises a non-metal. Suitable non-metals include rigid plastics such as Perspex and high density polyethylene or some composite materials.

The elongate strip may be of any suitable dimensions provided that it remains sufficiently flexible to be able to adopt the shape of the camber of the highway. A typical example may have a long axis of 3 m, a short axis of 0.02 m and a thickness of 0.001 m.

Preferably, the optical fibre sensor further comprises at least one semi-reflective element coupled to the optical fibre. For a single, isolated sensor a semi-reflective element is used at either end of the sensor. However, more commonly a number of sensors are connected in series so that each individual sensor need have only one semi-reflective element. In this case, each semi-reflective element acts as the first semi-reflective element for one sensor and also as the second semi-reflective element for the preceding sensor. The exception to this is the last sensor in a series, which requires an additional, terminal semi-reflective element.

In the case of the optical fibre sensor comprising a sensing section and a dummy section preferably, the semi-reflective element is located on the dummy section of the optical fibre sensor.

Suitably, the semi-reflective element is either a fibre optic X-coupler with one port mirrored or a Bragg grating.

Preferably, each sensor is deployed so that its longest dimension is substantially in the plane of the highway and substantially perpendicular to the direction of traffic flow on the highway.

Preferably, the longest dimension of each sensor is substantially equal to the lane width of the highway.

This helps to ensure that the passage of any vehicle on any part of the highway is registered by the system.

In the UK the width of a lane of highway may range from around 2.5 m for a minor road up to round 3.7 m for a motorway. Other parts of the world may have road systems of differing lane widths.

Preferably, each sensor is deployed beneath the surface of the highway.

For deployment in an existing road, a thin channel or groove can be cut in the road to accommodate each sensor. The groove may then be re-filled and the surface of the road made good again. Clearly, in the case of a new road the sensors can simply be incorporated into the structure of the road during construction.

It is possible, but less preferred to deploy the sensors so that they are attached to the surface of the highway rather than embedded in it. This may be useful if the system is to be used for a short time in a particular location before being moved. Clearly, in this instance the sensors employed may need to be protected or be strong enough to be able to withstand the greater forces associated with vehicles passing directly over them.

In accordance with a second aspect of the present invention, a method for monitoring traffic comprises providing a plurality of sensor stations on a highway; deploying a plurality of optical fibre sensors at each sensor station; interfacing each optical fibre sensor to an interferometric interrogation system; employing time division multiplexing such that the interrogation system is adapted to monitor an output of each optical fibre sensor substantially simultaneously; and using the output of each optical fibre sensor to derive data relating to the traffic passing each sensor station.

Preferably, the method further employs wavelength division multiplexing such that the number of optical fibre sensors which the interrogation system is adapted to monitor is increased.

Preferably, the method further employs spatial division multiplexing such that the number of optical fibre sensors which the interrogation system is adapted to monitor is increased.

Preferably, the data derived relates to at least one of vehicle speed, vehicle weight, traffic volume, axle separation and vehicle classification.

The invention will now be described by way of example only with reference to the following drawings in which.

Figure 6:
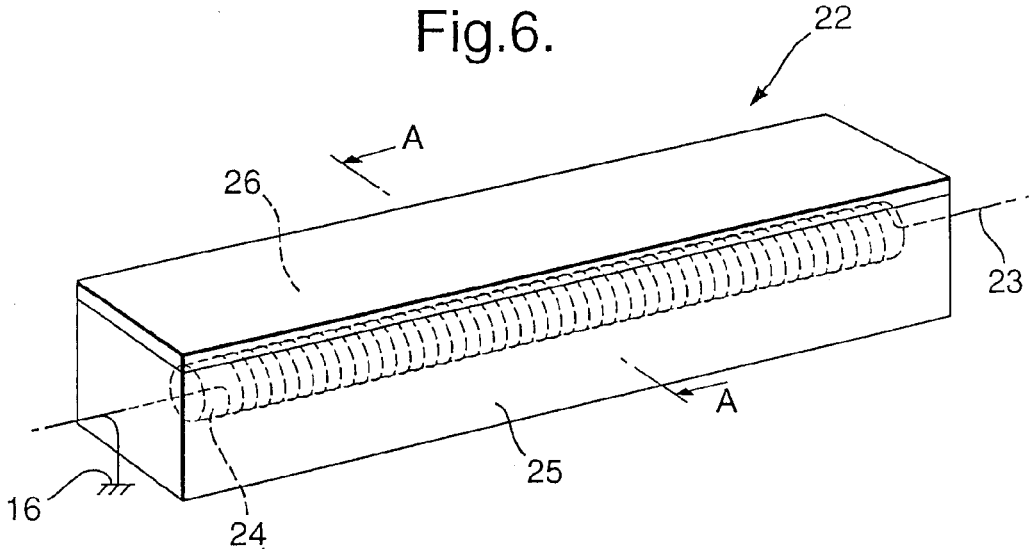
Figure 7:
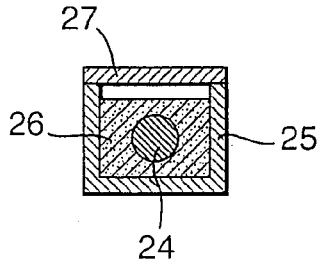
Figure 8:
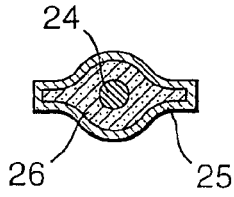

FIGS. 5 *a–d* show four further examples of optical fibre sensors suitable for use in a road traffic monitoring system according to the present invention;

FIG. 6 shows a perspective view of a further example of an optical fibre sensor suitable for use in a road traffic monitoring system according to the present invention;

FIG. 7 shows a cross section of the sensor of FIG. 6 taken along the line A—A;

FIG. 8 shows a cross section of an alternative shaped casing suitable for the sensor of FIG. 6.

Figure 9:
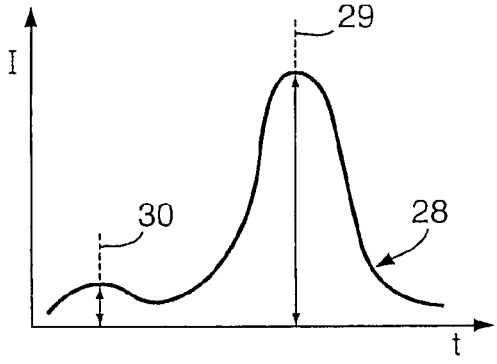

FIG. 9 shows a graphical representation of a typical response of a piezo electric sensor as a vehicle passes over it.

Figure 9A:
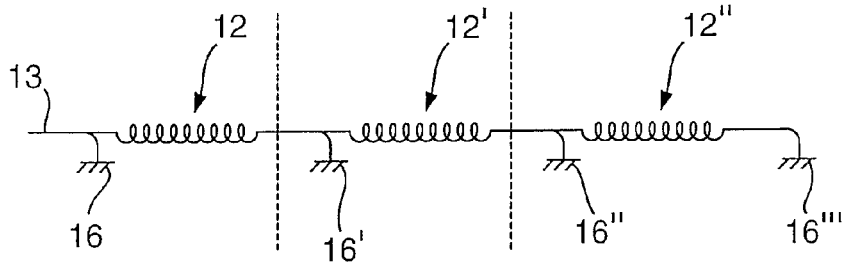
Figure 10:
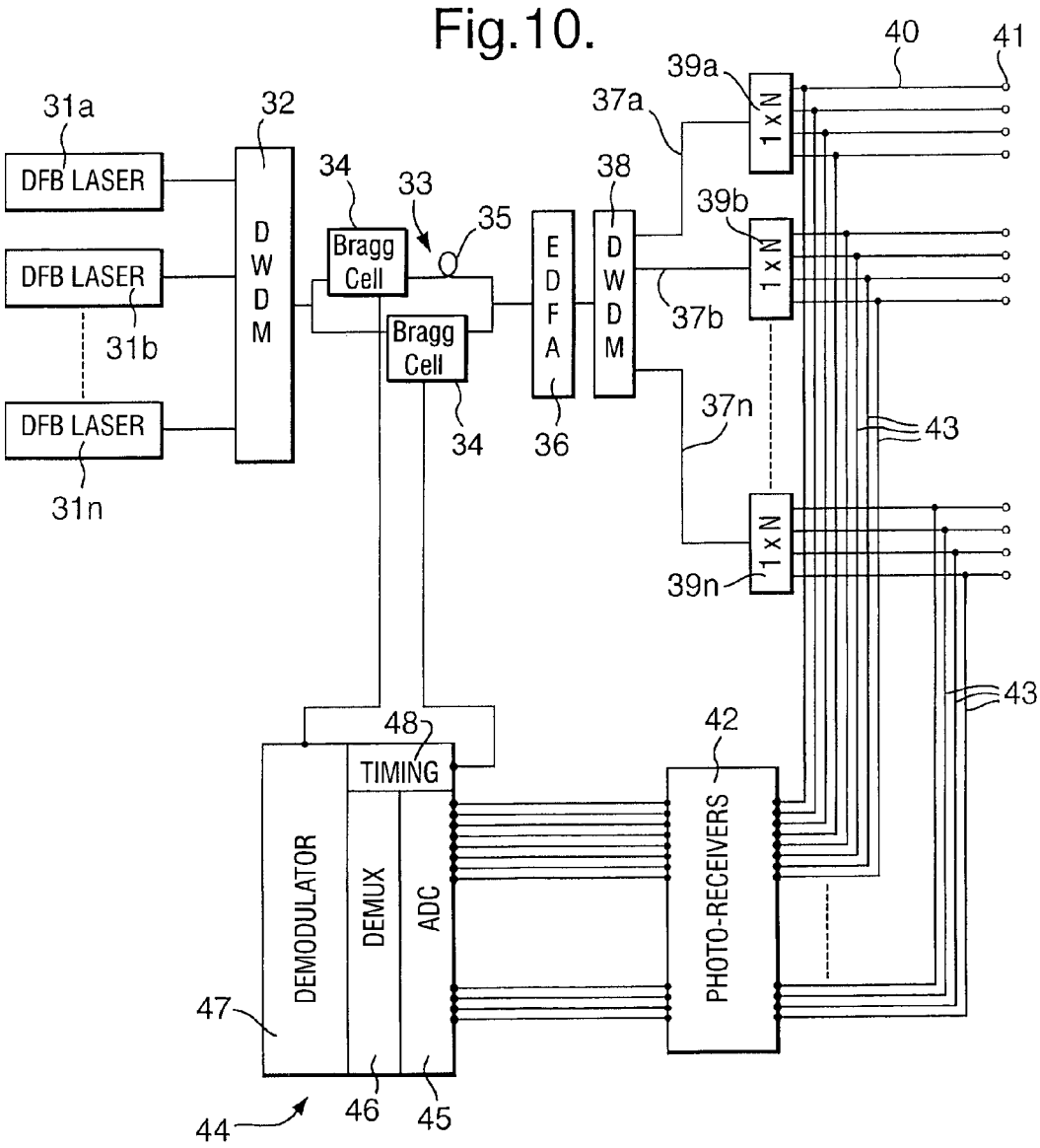
Figure 11:
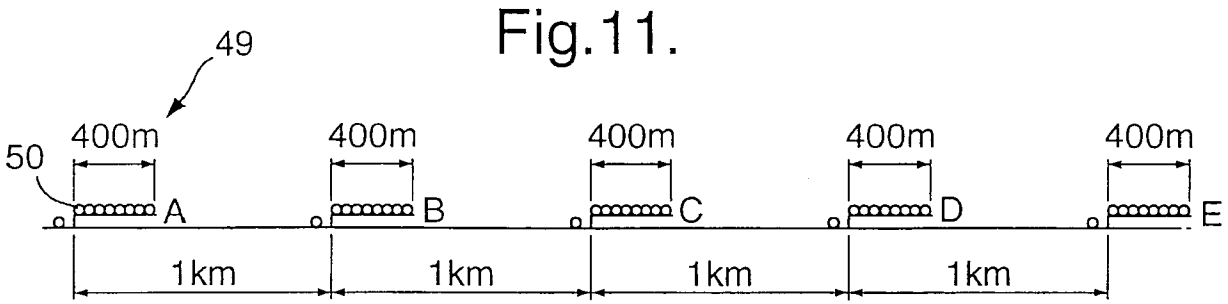
Figure 12:
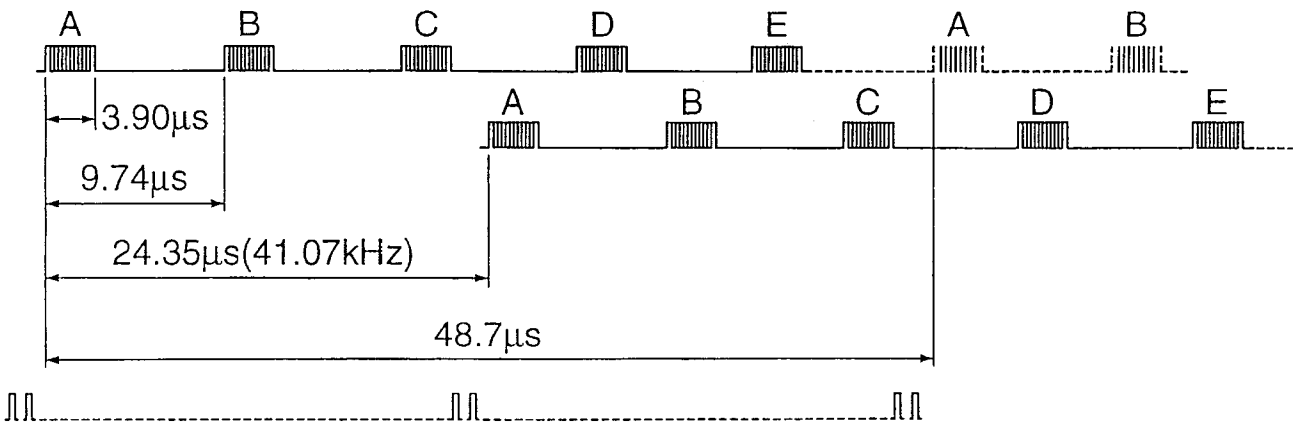
Figure 13:
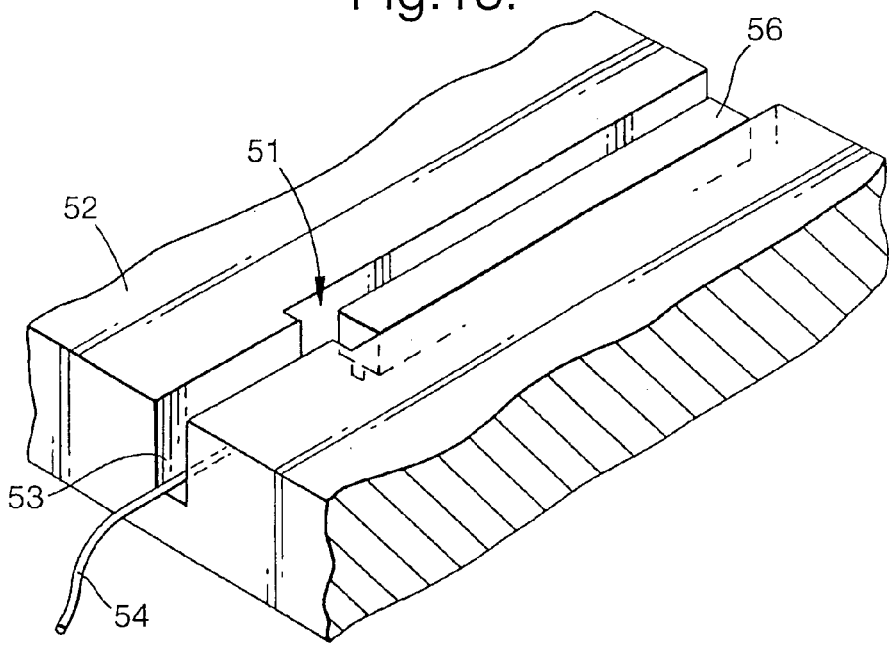
Figure 14A:
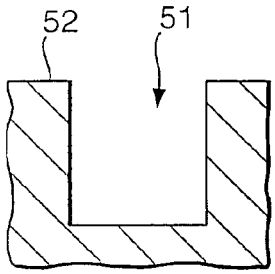
Figure 14B:
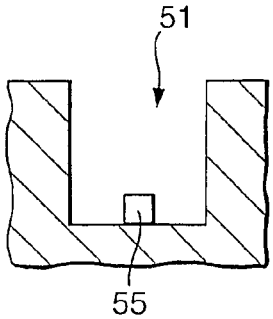
Figure 14C:
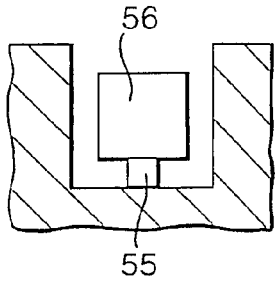
Figure 14D:
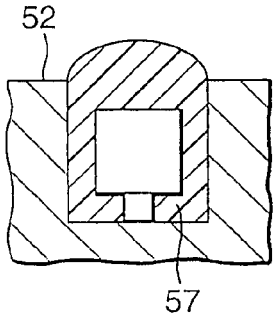
Figure 14E:
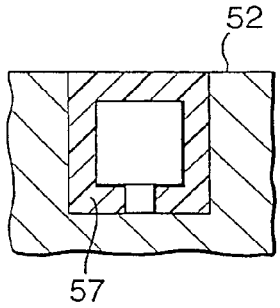
Figure 15A:
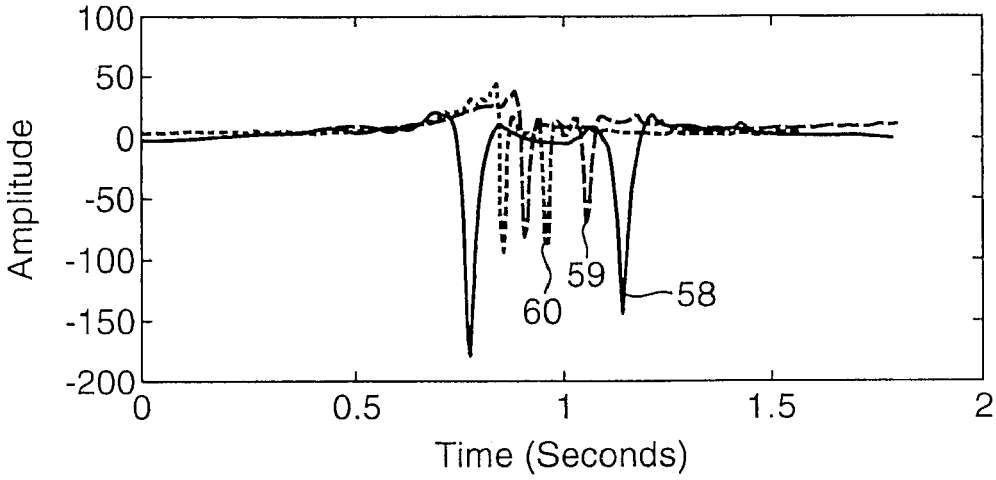
Figure 15B:
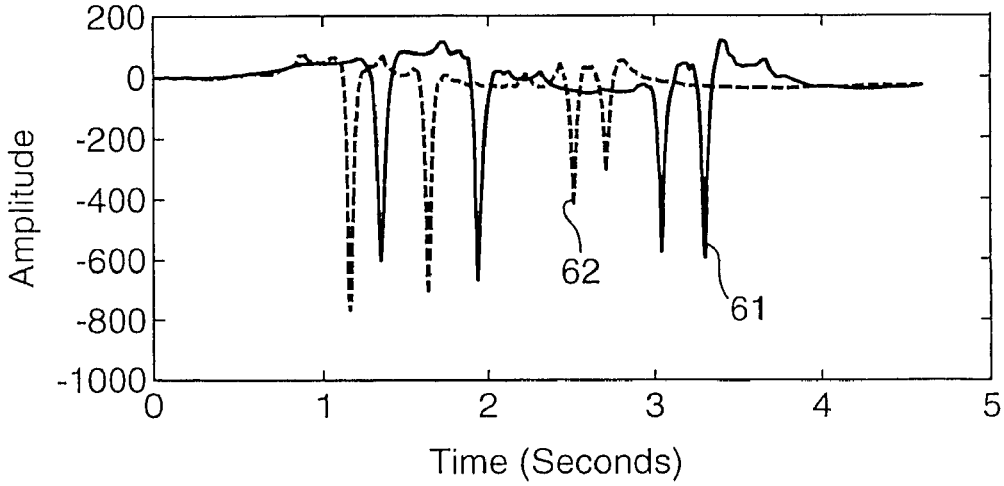

FIG. 9*a* shows a schematic diagram of three sensors connected in series;

FIG. 10 shows a schematic diagram of an interferometric interrogation system suitable for use in a traffic monitoring system according to the present FIG. 11 shows a representation of the spatial arrangement of a set of sensor groups which may be interrogated by the system of FIG. 10;

FIG. 12 shows the derivation of the optical signal timings for the set of sensor groups of FIG. 11;

FIG. 13 shows a perspective view of a sensor of the type shown in FIG. 6, deployed beneath the surface of a highway;

FIGS. 14*a–e*, illustrates how a sensor may be deployed beneath the surface of a highway; and, FIGS. 15*a–b* show the signals recorded from a car and an HGV passing over a sensor of the type shown in FIG. 6.

Figure 1:
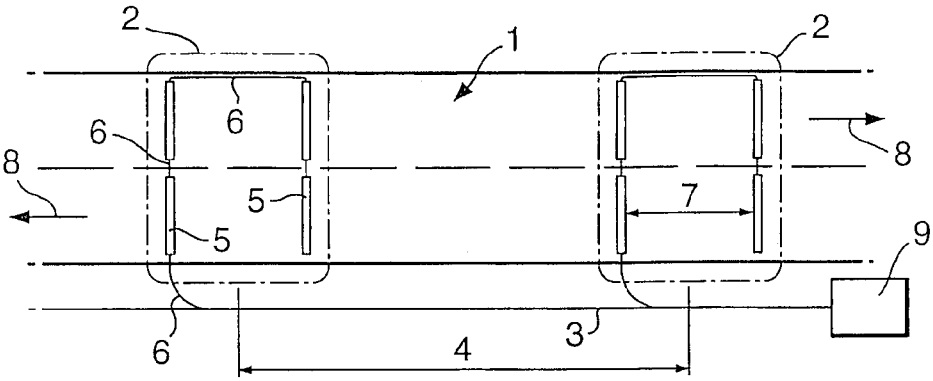
FIG. 1 shows example of a section of a traffic monitoring system according to the present invention in place on a two lane highway.
Figure 2:
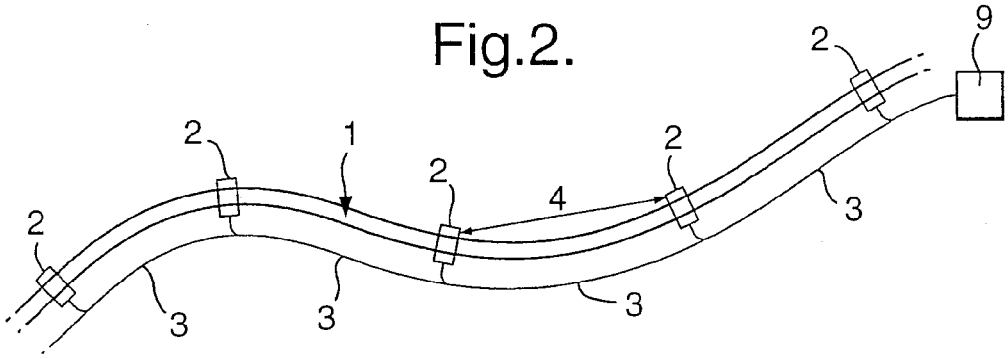
FIG. 2 shows an extended section of a traffic monitoring system according to the present invention.

FIG. 1 shows a section of a traffic monitoring system in place on a two lane highway 1. Two sensor stations 2 are shown connected by a length of optical fibre 3. In FIGS. 1 and 2 the optical fibre 3 is shown extended and hence the physical separation of the sensor stations, indicated by distance 4 is substantially equal to the optical path length of the optical fibre 3. Optical fibre 3 need not be fully extended, in which case the physical separation of the sensor stations, distance 4, may be less than the optical path length of the optical fibre 3. A more extended section of the system showing five sensor stations 2 is shown in FIG. 2

Each sensor station 2 comprises four fibre optic sensors 5, connected to one another in series and to optical fibre, 3 by optical fibre 6. At each sensor station 2 the sensors 5 are deployed in the highway 1 such that there are two sensors, separated as indicated by distance 7, per lane of the highway. Arrows 8 represent the direction of travel of traffic on each lane of the highway. Each sensor is arranged such that its longest dimension is perpendicular to the direction of traffic flow 8, and substantially equal to the width of a lane or the highway. This ensures that a vehicle passing a given sensor station 2 will elicit a response from at least one fibre optic sensor 5, irrespective of its direction of travel or positioning on the lane of the highway. A knowledge of the physical separation of the sensors 7 within each sensor station allows a determination of vehicle speed to be made. All sensor stations are connected by optical fibre 3 to an interferometric interrogation system 9.

Figure 3:
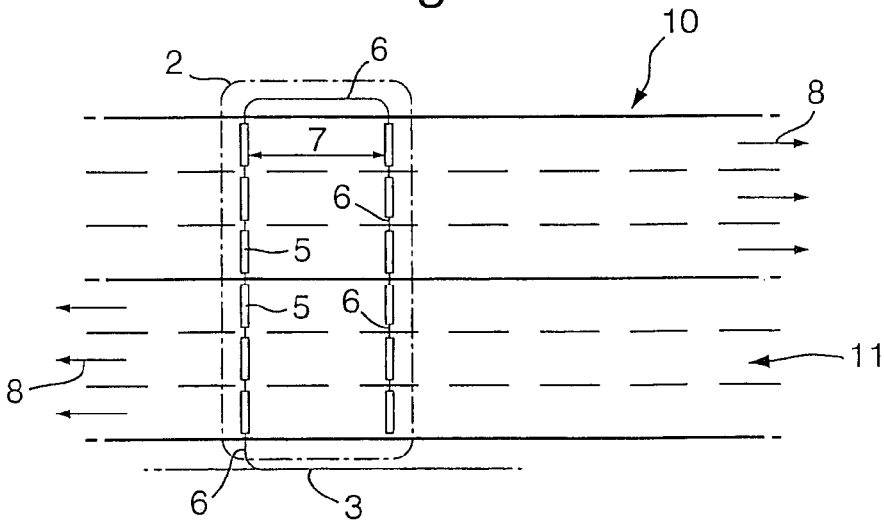
FIG. 3 shows a single sensor station suitable for a traffic monitoring system according to the present invention in place on a six lane highway.

In FIG. 3 a single sensor station 2 is shown in place as part of a traffic monitoring system for a multi-lane highway 10, for example a motorway. In this case twelve sensors 5 are deployed in order to ensure that a vehicle passing the sensor station on any of the six lanes 11 of the highway elicits a response irrespective of its direction of travel 8 or its choice of lane 11.

Figure 4:
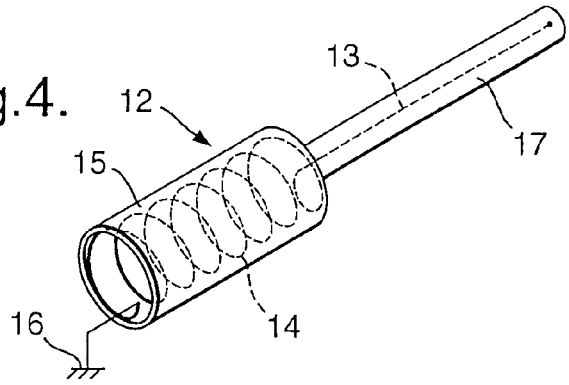
FIG. 4 shows an example of an optical fibre sensor suitable for use in a road traffic monitoring system according to the present invention.
Figure 5A:
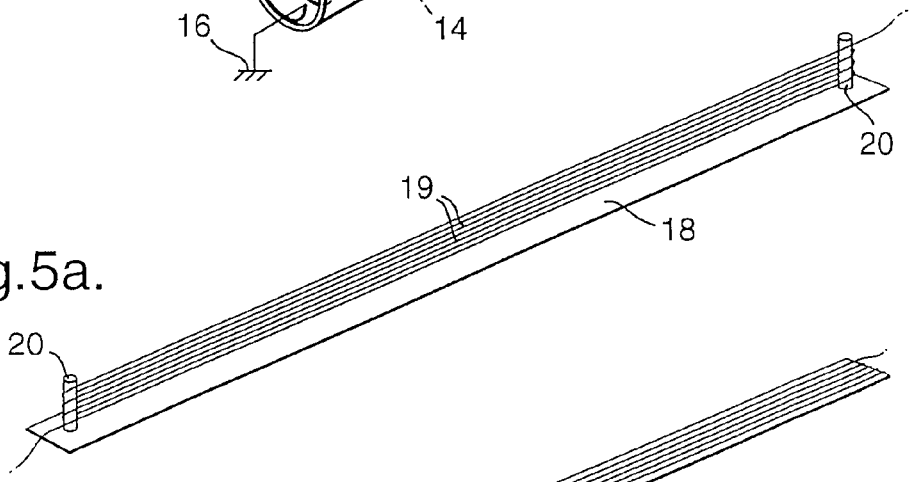
Figure 5B:
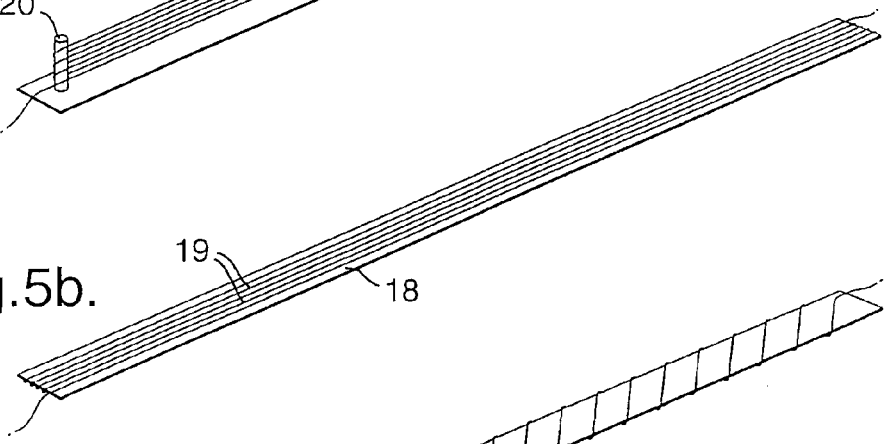
Figure 5C:
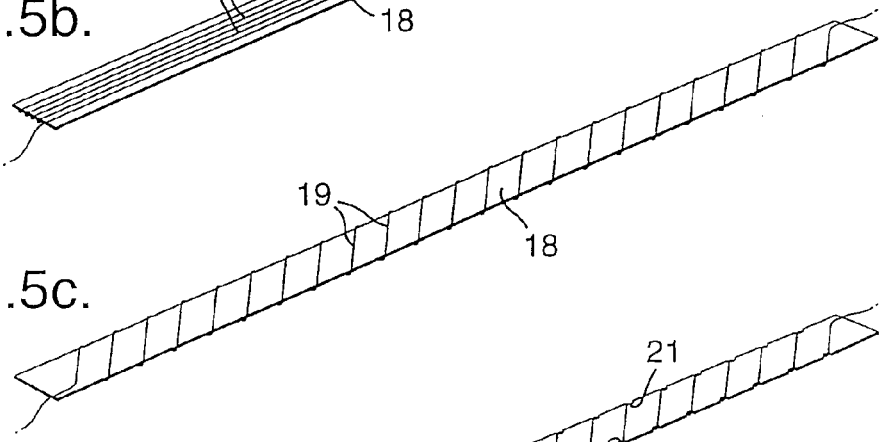
Figure 5D:
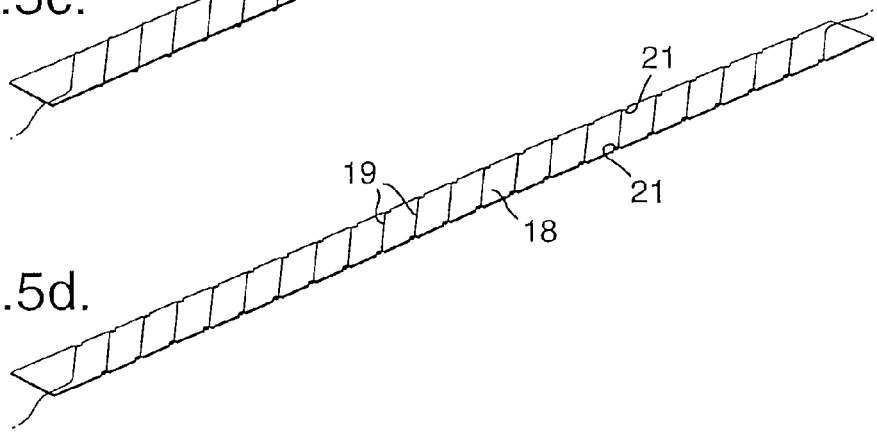

A first example of a sensor design is shown in FIG. 4. The sensor 12 comprises a sensing fibre 13 and a dummy fibre 14. In this example the dummy fibre is shown coiled inside a casing 15. A semi-reflective element 16 is coupled to the dummy fibre. This arrangement allows a large length of dummy fibre to be contained in a small volume, thereby reducing the overall size of the sensor. Other arrangements are clearly possible, the dummy fibre may be wound on a reel or former or, if the overall size of the sensor is unimportant, simply left extended. In FIG. 4, a sheath 17 is shown around the sensing fibre 13. This may be separated to, or integral with, the dummy fibre casing 15. The sheath 17 serves to protect the sensing fibre from damage. It may for example, comprise a metal or a plastic. The cross sectional shape of the sheath is preferably chosen such that it provides the sensor with lateral rigidity.

It is possible, but less preferred, to omit either or both of the casing 15 and the sheath 17. This reduces the cost and complexity of the sensor, but results in a less robust sensor which may be damaged easily.

In use, the sensor is deployed in such a way that the sensing fibre 13 extends across the width of the highway lane to be interrogated. The force exerted by a vehicle passing over he sensing fibre produces a signal which can be detected by the interrogation system. The length of the sensing fibre, typically around 2 to 4 m, means that the sensitivity of the sensor is low. It is thus suitable for detecting the large forces associated with the passage of vehicles. The dummy fibre 14 is positioned such that it is not affected by the passage of vehicles. This may be achieved by arranging for the dummy fibre to be at the edge of the highway or between lanes of the highway. The packaging of the dummy fibre may be arranged to insulate the fibre from vibrations.

A second sensor design is shown in FIG. 5. This design of sensor is based around a thin strip 18 which is commonly a metal strip. The optical fibre 19 is attached to the strip to form the sensor. In FIG. 5*a*, the optical fibre is wound around two spindles 20 attached to each end of the strip. FIGS. 5*b*, 5*c* and 5*d* omit the spindles and have the fibre wound around the strip itself. The fibre may be wound longitudinally, FIG. 5*b* or helically around the short axis of the strip, FIGS. 5*c* and 5*d*. In FIG. 5*d*, small indents 21 are made into the edges of the strip 18. These are useful in locating the optical fibre as it is wound. In each example, the fibre may be protected by applying a thin overlayer of epoxy or polyurethane (not shown). The use of a thin strip as a former provides sensors which are flexible. This enables them to adopt the camber of the highway into which they are deployed and also allows them to be wound onto a drum for ease of storage and deployment. Clearly, modifications to the design of the sensors shown in FIG. 5 may be made without departing from the scope of the present invention. Semi-reflective elements have been omitted from FIG. 5 for clarity.

A further example of a sensor 22 shown in FIGS. 6 and 7, comprises an optical fibre 23 wound round a steel bar 24 and placed into a casing 25. In this example the optical fibre 23 is a 50 m length of double coated, high numerical aperture fibre with an outside diameter of 170 μm (FibreCore-SM1500—6.4/80), although other lengths and specifications of optical fibre may equally be used. The steel bar 24 is a 3 m length of M12 threaded bar and the optical fibre is wound in co-operation with the thread. This makes it simple to wind the optical fibre evenly along the length of the bar. A 10 mm diameter unthreaded bar can be used in place of the M12 bar, although this makes it more difficult to ensure that the fibre is wound evenly. Alternatively, a more widely spaced, machined helical groove may be used instead of a thread. Clearly, the dimensions of the bar can be altered to provide a sensor of the appropriate size for a desired application. Furthermore, the bar need not comprises a metal bar, suitable alternative materials may include plastics, such as polyurethane and composite materials. A semi-reflective element 16 is coupled to one end of the fibre. If the sensor is to be used in isolation, or if it forms the terminal sensor in a series of sensors, then an additional semi-reflective element is coupled to the other end of the sensor.

In order to reduce the sensitivity of the sensor so that it is suitable for detecting large forces and pressures, a compliant material 26 is provided intermediate the steel bar 24 and the casing 25. This material is able to absorb the majority of any external force applied to the sensor. Unlike traditional optical fibre sensors where high sensitivity is often paramount, this sensor design is deliberately de-sensitised by choosing a compliant material which effectively absorbs the majority of any applied force. This means that a sensor comprising a highly compliant material, such as a grease, may be used to detect larger forces and pressures than would ordinarily be possible with existing optical fibre sensors. During manufacture, it is convenient to partially fill the casing 25 with the compliant material 26 and then place the bar 24 and optical fibre 23 on top. The bar is then overfilled with more of the compliant material. As shown in FIG. 7, this results in the bar being completely surrounded by the compliant material. An optional cap 27 may be provided to protect the sensor. This is useful if the compliant material 26 is chosen to be a soft material such as a grease. It may be possible to omit the cap 27, if the compliant material is one which is designed to set, for example an epoxy resin.

The casing 25 is made from sheet steel but can be made from any suitable material, such as aluminium, and is conveniently, slightly longer than the steel bar 24. FIGS. 6 and 7 show a casing with a substantially rectangular cross section. This shape adds lateral rigidity to the sensor and helps to eliminate a type of signal ambiguity which is often encountered with piezo-electric sensors. This signal ambiguity is illustrated in FIG. 3. The curve 28 of signal strength against time, represents a typical response due to a vehicle passing over a piezo-electric sensor. It consists of two peaks 29, 30. The main peak 29 is produced as the vehicle passes directly over the sensor. It is this part of the signal which is of use. The second smaller peak 30, produced prior to the main peak, is due to the surface of the road being pushed up by the weight of the vehicle as it travels along. This produces what is sometimes referred to as a 'bow wave' which travels ahead of the vehicle. The lateral rigidity afforded by the box shaped cross section of the casing in the present example reduces the effect of the 'bow wave', giving a signal which is representative of a vehicle as it passes directly over the sensor.

An alternatively shaped, casing which also provides lateral rigidity and hence reduces the 'bow wave' effect is shown in FIG. 8.

Other alternatively shaped casings may be used, for example the casing may comprise a cylindrical tube with an internal diameter slightly larger that the outer diameter of the bar 24. In this case the annular void formed between the bar and the casing would be filled with a compliant material.

In FIG. 9*a*, three sensors 12, 12' and 12" are shown connected in series. Sensors 12 and 12' each have one semi-reflective element 16 and 16' respectively, coupled to the optical fibre 13. In use, sensor 12 employs both semi-reflective elements 16 and 16'. Similarly, sensor 12' is defined by semi-reflective elements 16' and 16". Sensor 12" is a terminal sensor, hence it has two semi-reflective elements coupled to the fibre 16" and 16'''.

FIG. 10 shows an example of an interferometric interrogation system. The architecture of FIG. 10 is based upon a reflectometric time division multiplexed architecture incorporating some additional wavelength and spatial division multiplexing. The light from n distributed feedback (DFB) semiconductor lasers 31 is combined using a dense wavelength division multiplexer (DWDM) 32 before passing through an interferometer 33. The interferometer 33 comprises two acousto-optic modulators (AOM) which are also known as Bragg cells 34 and a delay coil 35. Pulses of slightly different frequency drive the Bragg cells 34 so that the light pulses diffracted also have this frequency difference. The output from the interferometer is in the form of two separate interrogation pulses. These are amplified by an erbium doped fibre amplifier (EDFA) 36, and then separated into n different fibres 37 by a second DWDM 38. Each fibre 37 feeds into a 1×N coupler 39. Each coupler 39 splits the input into N fibres 40. In FIG. 10 each coupler 39 is shown as having four output fibres 40, that is N=4. N may be greater or less than this as required. It is also not necessary that all 1×N couplers 39 have the same value for N. Each fibre 40 terminates in a sensor, a group of sensors or a number of groups of sensors 41. It is clear that the number of individual sensors which can be interrogated by the architecture of FIG. 8 may be large. A typical system may have n=8 and N=4 with 5 groups of 8 sensors connected to each output fibre 40. This provides a system where 1280 individual sensors may be interrogated. The maximum number of sensors is limited by the optical power budget, but may be up to several thousand or more.

The return light from the sensors is passed to individual photo-receivers 42 via return fibres 43. The photo-receivers can incorporate an additional polarisation diversity receiver which is used to overcome the problem of low frequency signal fluctuations caused by polarisation fading. This is a problem common to reflectometric time division architectures. Electrical signals are carried from the photo-receivers to a computer 44 which incorporates an analogue to digital converter 45, a digital demultiplexer 46, a digital demodulator 47 and a timing card 48. After digital signal processing within the computer the signal may be extracted as formatted data for display or storage or converted back to an electrical signal via a digital to analogue converter (not shown).

The success of the architecture of FIG. 10 is critically dependent upon the correct timing of the optical signals. This is achieved by using specific lengths of optical fibre within each sensor, between each sensor within a group of sensors and between each group of sensors. An example arrangement is shown in FIG. 11, where five groups 49 of sensors, each group comprising eight individual sensors 50, are shown separated by a distance of 1 km. Each sensor 50 comprises a total of 50 m of optical fibre so each group 49 has an optical path length of 400 m.

On first inspection it may seem to be necessary to deploy groups of sensors at exactly known and measured intervals, for example every 1 km. This is not the case as delay coils may be used to allow sensor groups to be deployed closer together. If a sensor group cannot be deployed within a set distance then a dummy sensor group consisting of a 400 m coil of fibre could be used and the next group of sensors then deployed on the carriageway. Altering the timing of the interrogation pulses will also allow for various group spacings, for example 500 m, 1 km 5 km as required.

Using the specific fibre lengths defined in FIG. 11, it is possible to define the optical signal timings. This is shown in FIG. 12. This shows that a sampling rate of approximately 41 kHz should be possible for each group of sensors. This results in a high dynamic range over a measurement bandwidth of several kHz at each sensor.

The pulse train to the sensors consists of a series of pulse pairs, where the pulses are of slightly different frequencies. At each end of each sensor is a semi-reflector. The pulse separation between the pulses is such that it is equal to the two-way transit time of the light through the fibre between these semi-reflectors. When these semi-reflectors reflect pulse pairs, the reflection of the second pulse overlaps in time with the reflection from the first pulse from the next semi-reflector along the fibre. The pulse train reflected from the sensor array consists of a series of pulses each containing a carrier signal being the difference frequency between the two optical frequencies. The detection process at the photodiode results in a series of time-division-multiplexed (TDM) heterodyne pulses, each of which corresponds to a particular sensor in the array. When a pressure signal impinges on a sensor it causes a phase modulation of the carrier in the reflected pulse corresponding to that sensor.

To implement the scheme of FIGS. 11 and 12 there is a requirement to generate accurate timing pulses as well as a reasonably sophisticated demultiplexing and demodulation process. By using a computer equipped with analogue to digital converters and able to perform digital signal processing, it is possible to do all of the necessary processing in the digital domain. This improves bandwidth and dynamic range when compared to more conventional analogue approaches.

FIGS. 13 and 14 show one example of how sensors may be deployed beneath the surface of a highway. A slot or groove 51 is cut into the surface of a highway 52 using a disk cutter. The groove, which is usually slightly longer than the sensor, includes a thinner section 53 used as a channel to accommodate a lead out optical fibre 54. FIG. 13 shows only a lead out groove from one end of the sensor, clearly a similar groove would be cut at the other end of the sensor to enable two sensors to be connected together. Stand off blocks 55 are placed at intervals along the base of the groove, suitably every 0.5 m or so. The sensor 56 is then deployed on top of the stand off blocks 55. The stand off blocks ensure that the sensor is not directly in contact with the base of the groove thereby helping to insulate it from vibrations. Once the sensor is in place, a potting resin 57 is poured into the groove so that the sensor is completely encapsulated. The stand off blocks allow the potting resin to flow beneath the sensor. Preferably, the groove is slightly overfilled with potting resin as shown in FIG. 14*d*. After a final operation to grind the surface of the resin flush with the surface of the highway, the sensor is suitable for use.

EXAMPLE 1

A single sensor of the type shown in FIG. 6, was deployed in a highway as described in FIGS. 13 and 14. FIG. 15*a* shows the response of the sensor as a car is driven over it at three different speeds; 15 mph, 30 mph and 55 mph shown by data curves 58, 59 and 60 respectively. Each curve comprises two peaks which correspond to the two axles of the car. The distance between the peaks is representative of the axle separation and the axle weight can be derived as a function of the integrated area bounded by each peak and the vehicle speed. In this example the vehicle weight can be derived as the speed of the vehicle is known. As described previously, at least two sensors, separated by a known distance, are required to measure the speed of a passing vehicle.

EXAMPLE 2

FIG. 15*b* shows the data collected as an articulated vehicle was driven over the sensor used in example 1 above. Data curves 61 and 62 represent a laden vehicle and an unladen vehicle respectively. Each curve comprises four peaks, corresponding to the four axles of the vehicle. Again the axle weight is derived from a knowledge of the vehicle speed and the area bounded by the peaks. In this example, however, as the speed of the vehicle was the same for both the laden test and the unladen test, the numerical difference between the areas bounded by the peaks gives a direct indication of the weight difference of the vehicle. This weight difference is equivalent to the weight of the load carried by the vehicle.

The invention claimed is:

1. A traffic monitoring system, the system comprising:

at least one sensor station comprising at least one optical fibre sensor, said sensor comprising a sensor section and a dummy section, wherein said at least one fibre sensor is an optical fibre, said optical fibre comprising said sensor section and said dummy section, said sensor section having an optical path length less than an optical path length of the dummy section; and an interferometric interrogation system responsive to an optical phase shift produced in the at least one optical fibre sensor due to a force applied to the at least one sensor station, wherein the interferometric interrogation system comprises a Rayleigh backscatter interferometric interrogation system, wherein said sensor section optical path length and said dummy section optical path length are sufficient to allow interrogation by said interferometric interrogation system.

2. A system according to claim 1, wherein the interferometric interrogation system comprises a reflectometric interferometric interrogation system.

3. A system according to claim 2, wherein the interferometric interrogation system comprises a pulsed reflectometric interferometric interrogation system.

4. A system according to claim 1, wherein the interferometric interrogation system comprises a pulsed Rayleigh backscatter interferometric interrogation system.

5. A system according to claim 1, comprising a plurality of sensor stations, wherein adjacent stations are connected together by a length of optical fibre.

6. A system according to claim 5, the length of optical fibre connecting adjacent sensor stations is between 100 m and 5000 m.

7. A system according to claim 1, wherein each sensor station comprises a plurality of optical fibre sensors.

8. A system according to claim 7, wherein each sensor station comprises at least one optical fibre sensor per lane of the highway.

9. A system according to claim 7, wherein each sensor station comprises at least two optical fibre sensors, separated from each other by a known distance, per lane of the highway.

10. A system according to claim 9, wherein the known distance is between 0.5 and 5 m.

11. A system according to claim 1, wherein each sensor is deployed so that its longest dimension is substantially in the plane of the highway and substantially perpendicular to the direction of traffic flow on the highway.

12. A system according to claim 1, wherein the longest dimension of each sensor is substantially equal to the lane width of the highway.

13. A system according to claim 1, wherein each sensor is deployed beneath the surface of the highway.

14. A system according to claim 1, wherein the optical path length of the dummy fibre is at least 2 times greater than that of the sensing fibre.

15. A system according to claim 1, wherein the sensing fibre is substantially straight.

16. A system according to claim 1, wherein the optical fibre sensor further comprises at east one semi-reflective element coupled to the optical fibre.

17. A system according to claim 16, wherein the semi-reflective element is located on the dummy fibre of the optical fibre sensor.

18. A system according to claim 16, wherein the semi-reflective element is either a fibre optic X-coupler with one port mirrored or a Bragg grating.

19. A traffic monitoring system, the system comprising:

at least one sensor station comprising at least one optical fibre sensor; and an interferometric interrogation system responsive to an optical phase shift produced in the at least one optical fibre sensor due to a force applied to the at least one sensor station, wherein the interferometric interrogation system comprises a Rayleigh backscatter interferometric interrogation system, wherein the at least one optical fibre sensor comprises a sensor fibre coupled to a dummy fibre; wherein the optical path length of the sensor fibre is such that the sensitivity of the sensor is low; and wherein the optical path length of the dummy fibre is greater than that of the sensor fibre such that the combined optical path length of the sensor fibre and the dummy fibre is sufficient to allow the sensor to be interrogated by said interferometric interrogation system, further comprising a casing substantially surrounding at least one of the sensor fibre and the dummy fibre.

20. A traffic monitoring system, the system comprising:

at least one sensor station comprising at least one optical fibre sensor; and an interferometric interrogation system responsive to an optical phase shift produced in the at least one optical fibre sensor due to a force applied to the at least one sensor station, wherein the interferometric interrogation system comprises a Rayleigh backscatter interferometric interrogation system, wherein the optical fibre sensor comprises a former and an optical fibre wound on the former; wherein the former is substantially planar and wherein the sensor is sufficiently flexible such the it is able to substantially adopt the shape of the camber of a highway.

21. A system according to claim 20, wherein the former comprises an elongate strip provided with two spindles; wherein the spindles are fixedly attached to the same face of the strip and disposed at a distance from each other; wherein each spindle protrudes substantially perpendicularly from the surface of the strip; and wherein the optical fibre is wound longitudinally between the spindles.

22. A system according to claim 20, wherein the former comprises an elongate strip and the optical fibre is wound longitudinally around the long axis of the strip.

23. A system according to claim 20, wherein the former comprises an elongate strip and the optical fibre is wound helically around the short axis of the strip.

24. A system according to claim 21, wherein the elongate strip comprises a metal strip.

25. A system according to claim 21, wherein the elongate strip comprises a non-metal.

26. A system according to claim 21, wherein the optical fibre sensor further comprises at least one semi-reflective element coupled to the optical fibre.

27. A system according to claim 26, wherein the semi-reflective element is either a fibre optic X-coupler with one port mirrored or a Bragg grating.

28. A method for monitoring traffic, the method comprising the steps of:

providing a plurality of sensor stations on a highway;

deploying a plurality of optical fibre sensors at each sensor station;

interfacing each optical fibre sensor to an interferometric interrogation system, said interrogation system employing time division multiplexing to monitor an output of each optical fibre sensor substantially simultaneously; and using the output of each optical fibre sensor to derive data relating to the traffic passing each sensor station, wherein the interferometric interrogation system uses a Rayleigh backscatter interferometric interrogation system employing wavelength division multiplexing such that the number of optical fibre sensors which the interrogation system is adapted to monitor is increased.

29. A method for monitoring traffic, the method comprising the steps of:

providing a plurality of sensor stations on a highway;

deploying a plurality of optical fibre sensors at each sensor station;

interfacing each optical fibre sensor to an interferometric interrogation system, said interrogation system employing time division multiplexing to monitor an output of each optical fibre sensor substantially simultaneously; and using the output of each optical fibre sensor to derive data relating to the traffic passing each sensor station, wherein the interferometric interrogation system uses a Rayleigh backscatter interferometric interrogation system, further employing spatial division multiplexing such that the number of optical fibre sensors which the interrogation system is adapted to monitor is increased.

30. A method according to claim 28, wherein the data derived relates to vehicle speed.

31. A method according to claim 28, wherein the data derived relates to vehicle weight.

32. A method according to claim 28, wherein the data derived relates to traffic volume.

33. A method according to claim 28, wherein the data derived relates to axle separation.

34. A method according to claim 28, wherein the data derived relates to vehicle classification.

* * * * *